United States Patent [19]

Schaenzer

[11] 4,142,441

[45] Mar. 6, 1979

[54] CENTERFIRE CARTRIDGE PRIMING TOOL

[76] Inventor: Gordon N. Schaenzer, 11737 N. Solar Ave., Mequon, Wis. 53092

[21] Appl. No.: 832,294

[22] Filed: Sep. 12, 1977

[51] Int. Cl.[2] ..... F42B 33/00

[52] U.S. Cl. ..... 86/24; 86/37

[58] Field of Search ..... 86/24, 37

[56] References Cited

U.S. PATENT DOCUMENTS 3,555,959 1/1971 Lee ..... 86/37

*Primary Examiner*—Stephen J. Lechert, Jr.

*Attorney, Agent, or Firm*—Quarles & Brady

[57] ABSTRACT

A centerfire cartridge priming tool intended for hand held use and including a one piece molded tool body and a shell casing holder integrally embedded in an end of the tool body. A lever is pivotally attached to the body adjacent the shell casing holder and is functioned to force a new primer into the priming chamber of the shell.

3 Claims, 6 Drawing Figures

CENTERFIRE CARTRIDGE PRIMING TOOL

BACKGROUND OF THE INVENTION

1. Field of the Invention

The invention relates to tools for use in inserting cartridge primers into centerfire cartridges or shells during reloading. More particularly, the invention relates to priming tools which can be hand held and which are readily portable.

2. Description of the Prior Art

A prior art hand held priming tool is shown in U.S. Pat. No. 3,555,959 issued Jan. 19, 1971 to Lee. Priming tools of the type shown therein are effective as a convenient, portable tool but the manufacturing costs of such tools make them relatively expensive to manufacture. The priming tool shown in the Lee patent includes a cast metal body having a generally axially extending cavity therein. One end of the metal body is machined to include internal threads whereby a machined shell holder having complementary threads can be threadably journalled in the end of the body. The priming tool also includes a relatively complicated lever mechanism to provide means for forcing a primer into the priming chamber of a shell casing, the lever mechanism including a machined elongated pusher arm having cam surfaces on both of its opposite ends.

SUMMARY OF THE INVENTION

The present invention provides an improved shell priming tool which is substantially less complicated in construction than any prior art priming tool, and markedly less expensive to manufacture. The shell priming tool of the invention is also more convenient to operate and requires less physical strength and effort than prior art priming tools.

A particular advantage of the priming tool of the invention is that it includes an improved lever assembly which permits the operator to force the primer into the shell priming chamber without substantial effort and also permits the operator to easily grasp the tool and apply the required force. The lever assembly is also designed to eliminate the need for the machined elongated pusher arm required in the prior art priming tool referred to above. The lever assembly of the priming tool of the invention thus eliminates the costs of construction of the elongated pusher arm.

Another advantage of the priming tool of the invention is that its structure avoids the necessity of a cavity extending the entire length of the priming tool body to house a lever assembly and thereby permits the priming tool body to be constructed as a one piece molded plastic unit while still providing required strength. By constructing the tool body of molded plastic, little machining of parts is required during its manufacture and the shell holder can be integrally embedded in the molded body thereby eliminating the need for machined threads to permit joinder of the shell holder and the body and the assembly operation to accomplish such joinder.

Before explaining the invention in detail, it is to be understood that the invention is not limited in its application to the details of construction defined in the following description or illustrated in the drawings. The invention is capable of other embodiments and of being practiced and carried out in various ways.

DESCRIPTION OF THE PREFERRED EMBODIMENT

The priming tool of the invention is comprised of an injection molded elongated plastic body 12 having a size such that it is conveniently held in the hand of the user. The body 12 includes a central tapered cavity formed in one side of the molded body 12 and the tapered cavity being generally U-shaped when viewed in a plane transverse to the longitudinal axis of the body. The upper end of the body 12 supports a shell holder 16 embedded therein so as to be immovably restrained. The shell holder 16 may be constructed of metal and includes a lower end having a peripheral flange 18 embedded in the plastic of the upper end of the body 12 to prevent removal of the shell holder 16.

Figure 6:
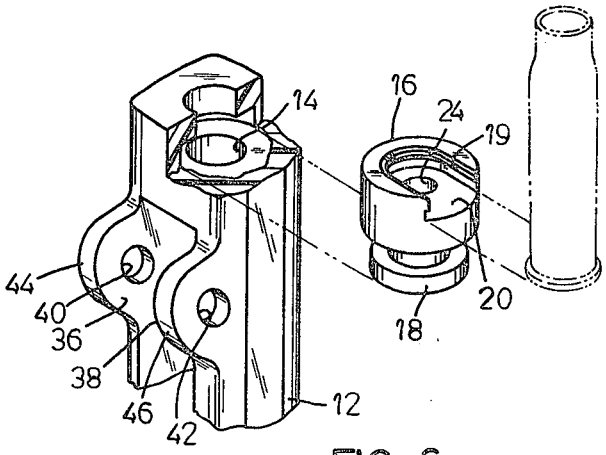
FIG. 6 is an exploded perspective view of the priming tool body and shell holder shown in FIG. 5.

The shell holder 16 includes an upper end having a slot or chamber 20 machined therein and functional to receive the lower end of a shell case shown in phantom in FIG. 6. The shell is restrained therein by an inwardly extending flange 19 surrounding the chamber 20 and functional to engage the circumferential flange of the shell base if the shell is subjected to a force in the direction of its longitudinal axis. The shell holder 16 also includes a central axial bore 24 extending from the chamber 20 into the cavity 14. The bore 24 is axially aligned with the primer bore of the shell case, and the bore 24 is intended to house the new primer before it is forced into the primer bore in a manner to be described hereinafter.

Figure 5:
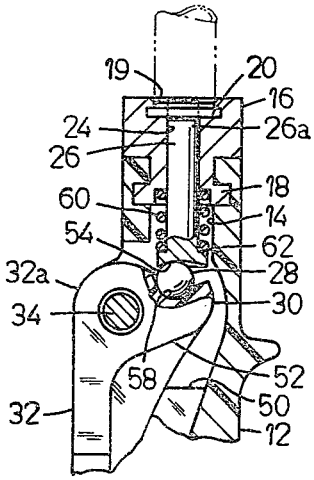
FIG. 5 is a partial view of the priming tool shown in FIG. 3 and showing the primer seating pin in a primer seating position.

A shiftable pin 26 includes an end slideably supported in the central bore 24 of the shell holder 16 and the upper end 26A of the pin 26 is movable into the chamber 24 of the shell holder 16 to force a primer into the primer bore of the shell chamber (FIG. 5).

The lower end of the slideable pin 26 is supported by a ball bearing 28 in turn supported by a cam lug 30 projecting inwardly into the cavity 14 of body 12, the cam lug 30 integrally extending from the upper end 32*a* of a pivotable lever 32. The upper end 32*a* of a lever 32 is pivotably joined to the body 12, adjacent to the upper end of body 12 and the shell holder 16, by a pivot pin 34. The pivot pin 34 extends transversely to the parallel planes of the opposed side walls 36 and 38 of the cavity 14 and is supported in aligned apertures 40 and 42 in integral projecting spaced apart lugs 44 and 46, respectively, of the body 12. The lever 32 is pivotable in a plane parallel and between the side walls 36 and 38 of the cavity 14 and consequently the projecting cam lug 30 projecting into the cavity 14 moves in an arcuate path parallel to the side walls 36 and 38 and generally in a vertical direction either toward or away from the shell holder 16. More particularly, when the lower end 32*b* of the lever 32 moves away from the lower end of the body 12, the cam lug 30 moves downwardly away from shell holder 16 and as a correlary, when the lower end 32*b* of the lever is forced toward the tool body 12, the cam lug 30 moves upwardly causing the ball 28 to apply an upward axial force on the shiftable pin 26 for forcing a primer into the priming chamber of the shell casing.

The opposed side walls 36 and 38 of the tool body 12 each include a ledge 50 which restricts the extent of motion of the pivotable lever 32. When the lower end of pivotable lever 32 is moved away from body 12, the lower edge 52 of the cam lug 30 is received against ledges 50 thereby limiting the movement of lever 32.

The ball bearing 28 is held between a concave seat 54 in the lower end of the shiftable pin 26 and a complementary concave seat 58 in the upper portion of the cam lug 30. The shiftable pin 26 is biased downwardly toward the ball bearing 28 by a coil spring 60, the spring 60 being disposed between a peripheral flange 62 surrounding the lower end of the shiftable pin 26 and the lower end of the shell holder 16. It will be noted that the ball bearing 28 functions to impart an axial upward force on the shiftable pin 26 as the cam lug 30 moves through a generally arcuate path.

Figure 2:
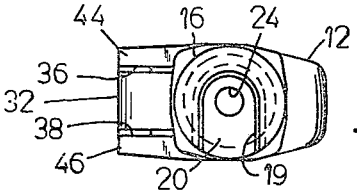
FIG. 2 is a top view of the priming tool shown in FIG. 1.
Figure 1:
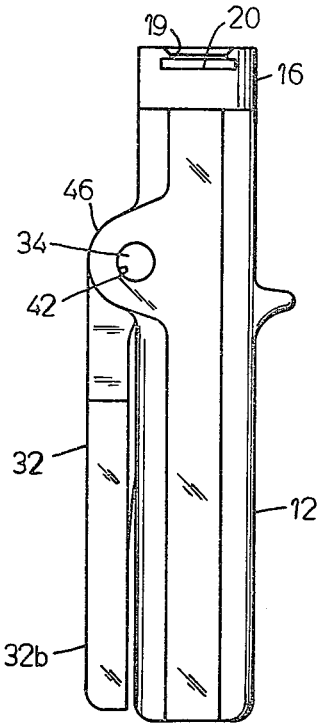
FIG. 1 is a side elevation view of a priming tool of the present invention.
Figure 4:
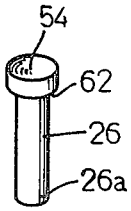
FIG. 4 is a perspective view of the primer seating pin of the priming tool shown in FIG. 3.
Figure 3:
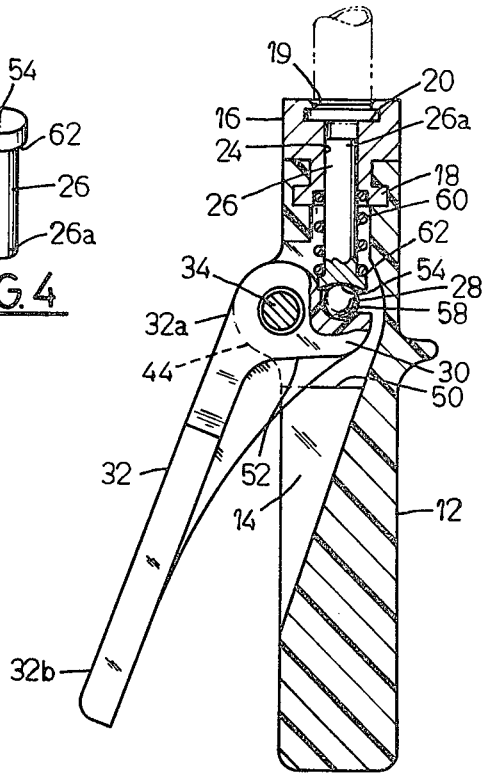
FIG. 3 is a cross section side elevation view of the priming tool shown in FIG. 1.

In operation of the priming tool, the lower end of the lever 32 is first pivoted away from the tool body 12 to the position shown in FIG. 3 whereupon the shiftable pin 26 is caused to retract downwardly by the coil spring 60 from the position shown in FIG. 5 to the position shown in FIG. 3. A primer can then be positioned in the upper end of the bore 24 to be supported by the upper end 26*a* of shiftable pin 26. The lower end of the shell casing is then slideably inserted into chamber 20 and the pivotable lever 32 is forced toward the tool body 12 thereby causing the cam lug 30 to move upwardly and the shiftable pin 26 to force the primer into the shell casing.

It will be noted that one of the advantages of the invention over the prior art is that its construction facilitates a very short moment arm between the axis of rotation of the pivotable lever 32 and the ball 28 and a much longer lever which is grasped by the operator. Thus the operator can generate a substantial upward force on the ball 28 with a relatively small force applied to lever 32. The lever and ball construction of the invention also facilitates more economical manufacture then prior art priming tools since a linkage between the lever 32 and the shiftable pin is avoided.

I claim:

1. A hand held shell priming tool for forcing a primer into a shell casing including :

an injection molded plastic tool body having an upper portion and a lower portion and including a cavity;

a shell holder embedded in said upper portion of said plastic body, said shell holder including a chamber for holding a base end of the shell casing and a central bore for receiving a primer therein that extends from said chamber to said cavity in the body;

a shiftable pin having an upper end in said central bore and shiftable into said chamber to force a primer into said shell casing, and a lower end in said cavity having a concave seat formed therein;

a pivotable lever having an inner end pivotally connected to said body adjacent said upper portion, and an outer end movable inwardly toward the lower portion of said body.

said inner end of said lever including an integrally projecting cam lug extending into said cavity in said body and positioned generally beneath said pin, said cam lug having a complementary concave seat formed therein opposite the lower end of said pin, which cam lug moves upwardly in a generally arcuate path when the outer end of the lever is moved inwardly; and ball means retained between engaged by the complementary concave seats of said pin and said cam lug so that as the lever is moved inwardly toward the tool body and the cam lug moves upwardly along its arcuate path an upward force is imparted by the ball means to the pin to force a primer into the shell casing.

2. The shell priming tool of claim 1, further including:

a spring positioned between the shell holder and the pin which upon the release of inward force on the lever moves the upper end of the pin out of the chamber.

3. The shell priming tool of claim 1, wherein: said ball means is a ball bearing.

* * * * *